US009248556B1

(12) United States Patent
Chen

(10) Patent No.: US 9,248,556 B1
(45) Date of Patent: Feb. 2, 2016

(54) POSITIONING DEVICE FOR RATCHET WRENCH

(71) Applicant: Zhi-Ji Chen, Taichung (TW)

(72) Inventor: Zhi-Ji Chen, Taichung (TW)

( * ) Notice: Subject to any disclaimer, the term of this patent is extended or adjusted under 35 U.S.C. 154(b) by 0 days.

(21) Appl. No.: 14/325,387

(22) Filed: Jul. 8, 2014

(51) Int. Cl.
*B25B 13/46* (2006.01)

(52) U.S. Cl.
CPC ..... *B25B 13/468* (2013.01); *B25B 13/463* (2013.01); *B25B 13/465* (2013.01)

(58) Field of Classification Search
CPC .... B25B 13/463; B25B 15/04; B25B 13/465; B25B 13/468
USPC ..... 81/62, 63.2, 58.4
See application file for complete search history.

(56) References Cited

U.S. PATENT DOCUMENTS 5,957,009 A * 9/1999 McCann ..... B25B 13/462 192/43
6,216,563 B1 * 4/2001 Hsieh ..... B25B 13/463 192/43.2
6,341,543 B1 * 1/2002 Hsieh ..... B25B 13/463 81/63.2
6,644,148 B2 * 11/2003 Hu ..... B25B 13/463 81/63
6,666,112 B2 * 12/2003 Hu ..... B25B 13/463 192/43.2
6,761,092 B2 * 7/2004 Hsien ..... B25B 23/0071 81/125
6,886,428 B1 * 5/2005 Hsien ..... B25B 13/463 81/63
6,945,141 B2 * 9/2005 Hu ..... B25B 13/463 81/63
7,017,453 B2 * 3/2006 Hu ..... B25B 13/463 81/63
7,162,937 B1 * 1/2007 Weng ..... B25B 13/463 81/63
8,596,169 B2 * 12/2013 Wang ..... B25B 13/461 81/58.1
8,943,929 B2 * 2/2015 Ou et al. ..... B25B 13/463 81/60

* cited by examiner

*Primary Examiner* — Hadi Shakeri
*Assistant Examiner* — Danny Hong

(57) ABSTRACT

A positioning device for a ratchet wrench contains: a driving head connecting with an operating handle and including an accommodating cavity, a toothed groove, and a slot, a depth of which is equal to the accommodating cavity. The driving head also includes an orifice and a horizontal notch, a depth of the horizontal notch is equal to the slot. The positioning device contains a rotatory block fixed in the driving head and including a first toothed section and a second toothed section; an abutting member fixed in the slot and including an elastic steel ball, plural locking teeth, an aperture, and a resilient element; a pushing post fixed in the horizontal notch of the driving head and including a peripheral recess, wherein one end of the pushing post is screwed with a screwing element; a cover locked on the driving head to cover the abutting member and the pushing post.

3 Claims, 7 Drawing Sheets

POSITIONING DEVICE FOR RATCHET WRENCH

FIELD OF THE INVENTION

The present invention relates to a positioning device for a ratchet wrench which is switched quickly to position or rotate the ratchet wrench.

BACKGROUND OF THE INVENTION

A conventional socket wrench contains a ratchet wrench and a fixed wrench, wherein the fixed wrench is operated troublesomely, but it is operated at a large torque; and the ratchet wrench is switched to rotate in a clockwise direction or a counterclockwise direction to screw/unscrew screw bolts, yet its torque output is less than the fixed wrench.

The present invention has arisen to mitigate and/or obviate the afore-described disadvantages.

SUMMARY OF THE INVENTION

The primary object of the present invention is to provide a positioning device for a ratchet wrench which is switched quickly to position or rotate the ratchet wrench at a large torque output.

Another object of the present invention is to provide a positioning device for a ratchet wrench in which a first toothed section engages with a plurality of locking teeth of an abutting member easily and securely.

To obtain the above objectives, a positioning device for a ratchet wrench provided by the present invention contains:

- a driving head connecting with a front end of an operating handle and including an accommodating cavity defined therein, a toothed groove arranged below the accommodating cavity, a slot formed on a rear end thereof and communicating with the accommodating cavity, wherein the slot has a depth equal to the accommodating cavity; the driving head also including an orifice obliquely extending downward from a central portion of a bottom end thereof and a horizontal notch defined on a rear end thereof, wherein a depth of the horizontal notch is equal to the slot;
- a rotatory block fixed in the driving head and including a first toothed section accommodated in the accommodating cavity and a second toothed section received in the toothed groove;
- an abutting member fixed in the slot and including an elastic steel ball retained in a rear end thereof, a plurality of locking teeth arranged around a front end thereof, an aperture formed on a bottom end thereof and corresponding to the orifice of the slot, and a resilient element mounted in the orifice and the aperture;
- a pushing post fixed in the horizontal notch of the driving head and including a peripheral recess defined around an outer rim of a central section thereof to correspond to the steel ball of the abutting member, wherein one end of the pushing post is screwed with a screwing element;
- a cover locked on the driving head by ways of plural locking elements to cover the abutting member and the pushing post.

DETAILED DESCRIPTION OF THE PREFERRED EMBODIMENTS

Figure 1:
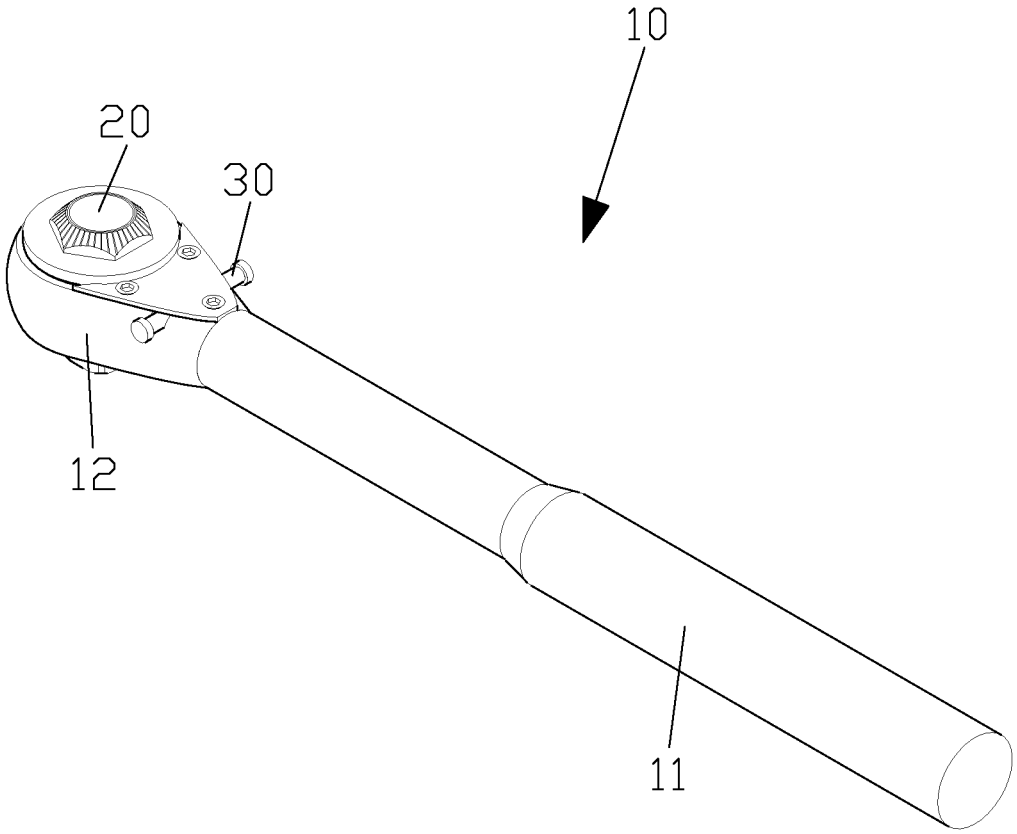
FIG. 1 is a perspective view showing the assembly of a positioning device for a ratchet wrench according to a preferred embodiment of the present invention.
Figure 2:
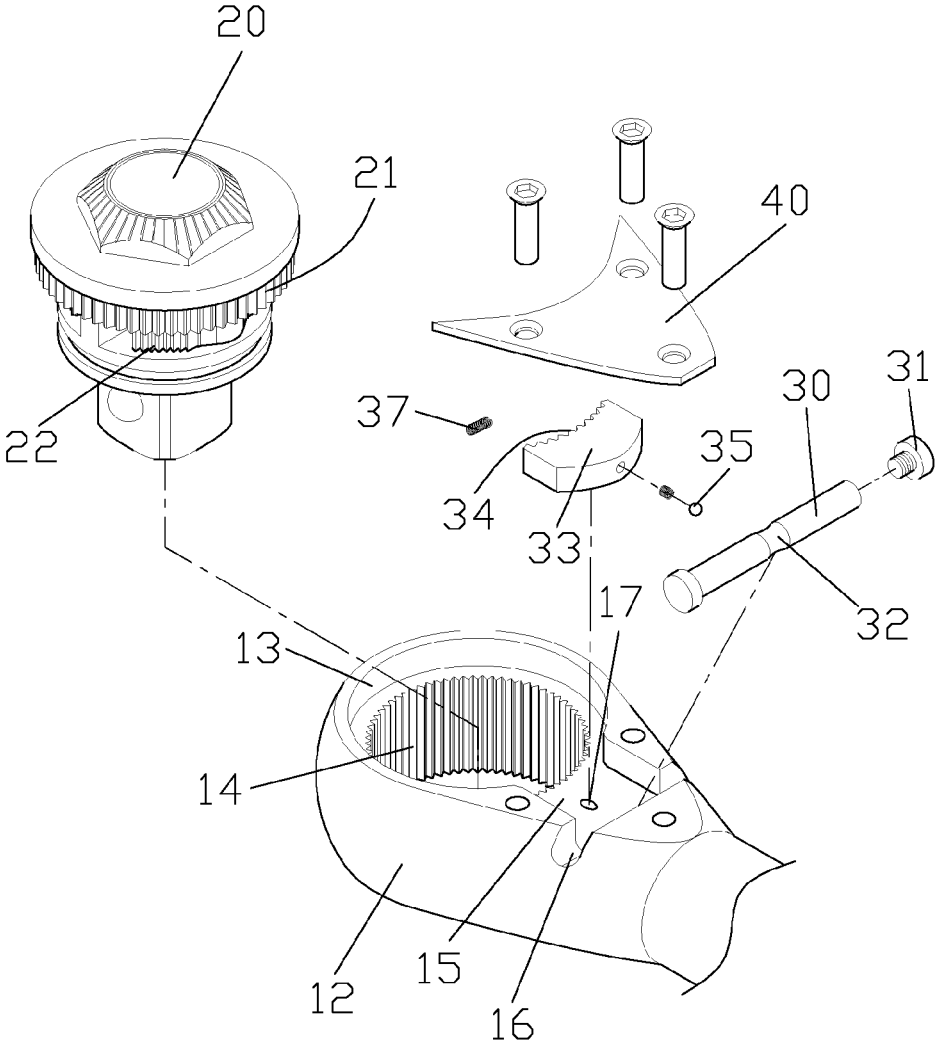
FIG. 2 is a perspective view showing the exploded components of the positioning device for the ratchet wrench according to the preferred embodiment of the present invention.
Figure 5:
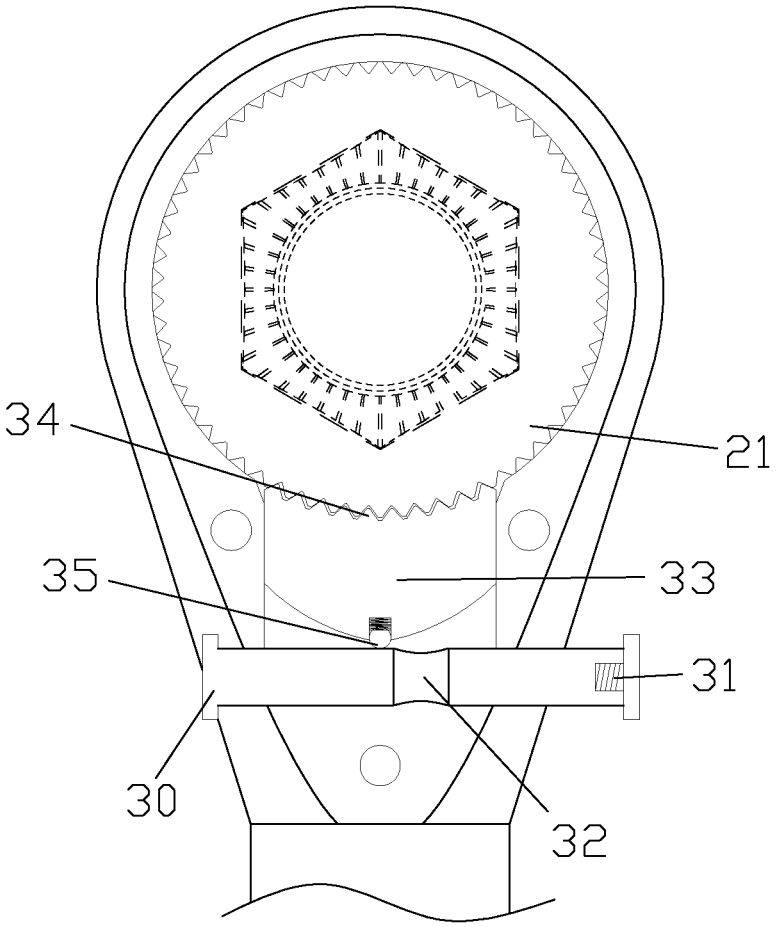
FIG. 5 is also another plan view showing the operation of the positioning device for the ratchet wrench according to the preferred embodiment of the present invention.

Referring to FIGS. 1, 2 and 5, a positioning device for a ratchet wrench according to a preferred embodiment of the present invention comprises: an operating handle 11 and a driving head 12 connecting with a front end of an operating handle, wherein the driving head 12 includes an accommodating cavity 13 defined therein to accommodate a first toothed section 21 of a rotatory block 20, the driving head 12 also includes a toothed groove 14 arranged below the accommodating cavity 13 to receive a second toothed section 22 of the rotatory block 20. The driving head 12 further includes a slot 15 formed on a rear end thereof and communicating with the accommodating cavity 13, wherein the slot 15 has a depth equal to the accommodating cavity 15, an orifice 17 obliquely extending downward from a central portion of a bottom end thereof, and a horizontal notch 16 defined on a rear end thereof, wherein a depth of the horizontal notch 16 is equal to the slot 15. The slot 15 has an abutting member 33 fixed thereon, and the abutting member 33 includes an elastic steel ball 35 retained in a rear end thereof, a plurality of locking teeth 34 arranged around a front end thereof, an aperture 36 formed on a bottom end thereof and corresponding to the orifice 17 of the slot 15, and a resilient element 37 mounted in the orifice 17 and the aperture 36. In addition, a pushing post 30 is fixed in the horizontal notch 16 of the driving head 12 and includes a peripheral recess 32 defined around an outer rim of a central section thereof to correspond to the steel ball 35 of the abutting member 33, wherein one end of the pushing post 30 is screwed with a screwing element 31, and a cover 40 is locked on the driving head 12 by ways of plural locking elements to cover the abutting member 33 and the pushing post 30.

Figure 3:
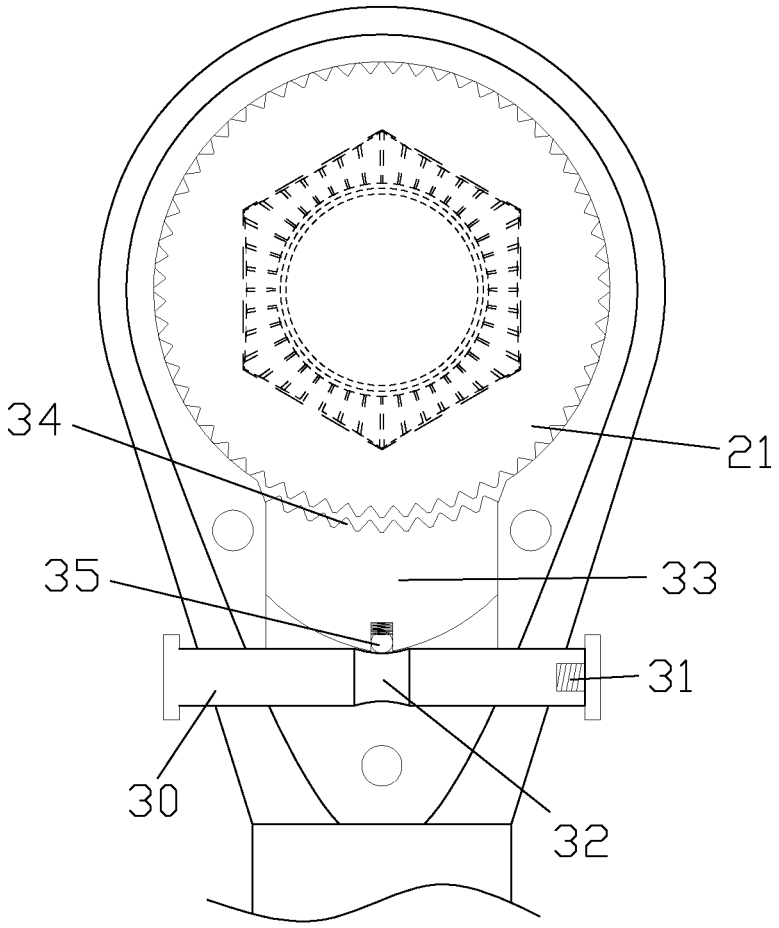
FIG. 3 is a plan view showing the operation of the positioning device for the ratchet wrench according to the preferred embodiment of the present invention.
Figure 4:
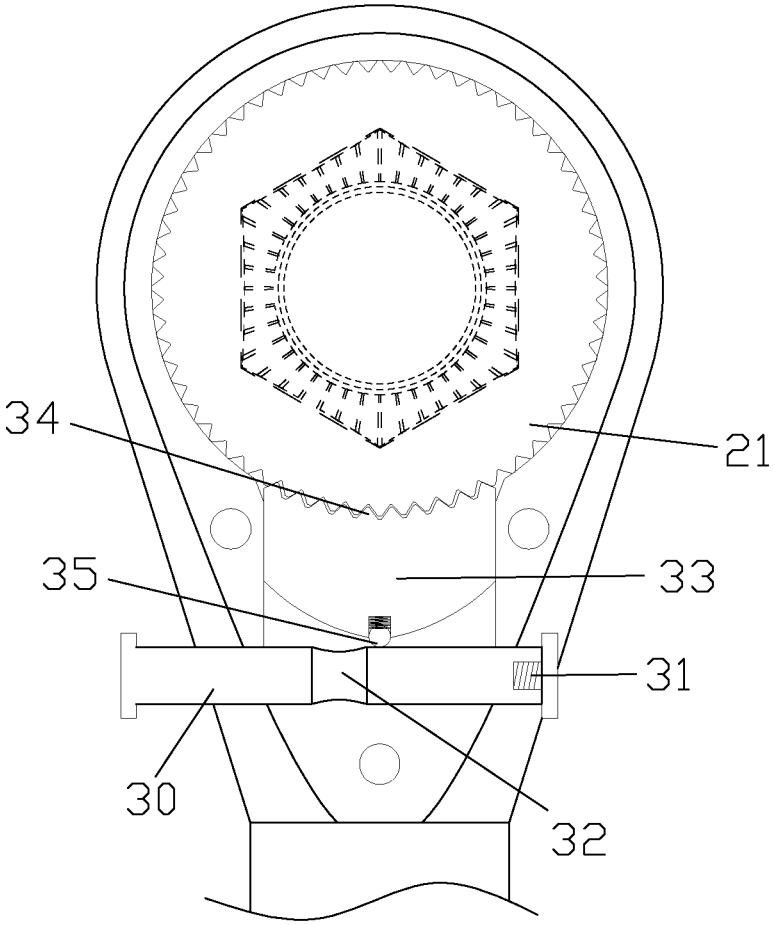
FIG. 4 is another plan view showing the operation of the positioning device for the ratchet wrench according to the preferred embodiment of the present invention.

Referring to FIG. 3, when the pushing post 30 is located relative to a central position of a rear end of the abutting member 33, the steel ball 35 is engaged in the peripheral recess 32 of the pushing post 30, and the plurality of locking teeth 34 do not engage with the first toothed section 21 of the rotatory block 20, such that the ratchet wrench 10 is rotated in a clockwise direction or a counterclockwise direction. As shown in FIGS. 4 and 5, when the pushing post 30 is pushed leftward or rightward, the steel ball 35 of the abutting member 33 disengages from the peripheral recess 32 of the pushing post 30 to abut against the pushing post 30, and the abutting member 33 is pressed to slide toward the slot 15, such that the plurality of locking teeth 34 of the abutting member 33 engage with the first toothed section 21 of the rotatory block 20 to limit a rotation of the rotatory block 20, thereby fixing the ratchet wrench 10.

Figure 6:
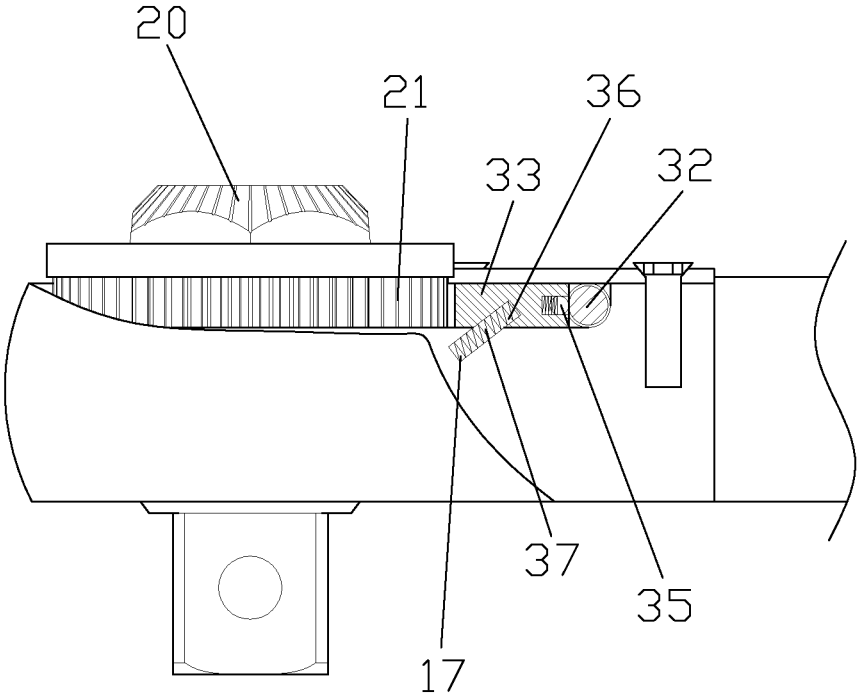
FIG. 6 is a cross sectional view showing the operation of the positioning device for the ratchet wrench according to the preferred embodiment of the present invention.
Figure 7:
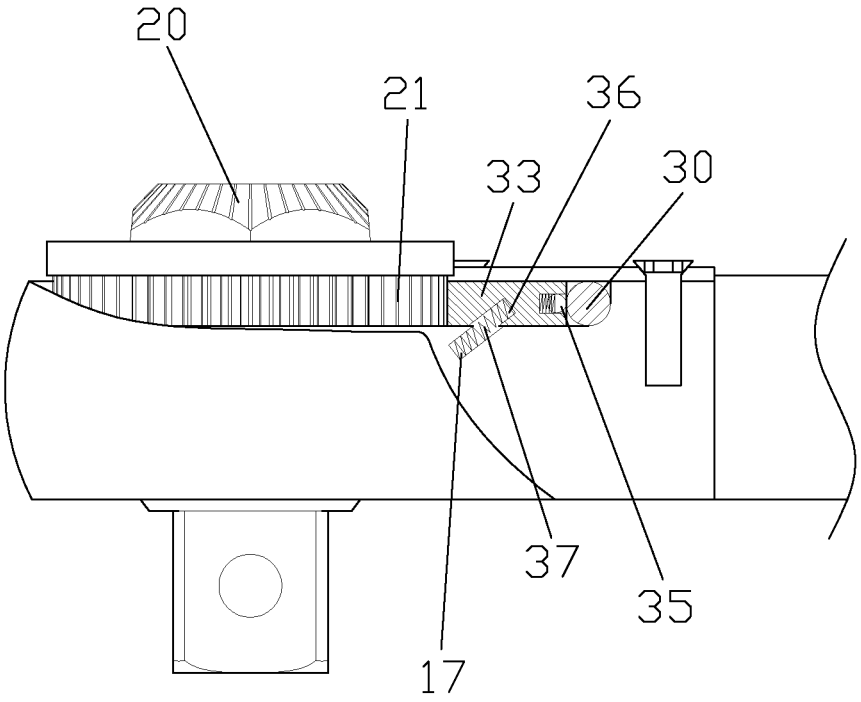
FIG. 7 is another cross sectional view showing the operation of the positioning device for the ratchet wrench according to the preferred embodiment of the present invention.

As illustrated in FIGS. 6 and 7, when the abutting member 33 engages with the first toothed section 21 of the rotatory block 20, the resilient element 37 in the orifice 17 and the aperture 36 is pressed, and when the pushing post 30 is pushed to move back to the central position of the rear end of the abutting member 33, the abutting member 33 is pushed by the resilient element 37 to move back to the slot 15 so that the first toothed section 21 is released, thus rotating the ratchet wrench 10.

Thereby, the ratchet wrench is switched to position or rotate quickly. Also, the first toothed section 21 engages with the plurality of locking teeth 34 of the abutting member 33 easily and securely.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A positioning device for a ratchet wrench comprising:

a driving head connecting with a front end of an operating handle and including an accommodating cavity defined therein, a toothed groove arranged below the accommodating cavity, a slot formed on a rear end thereof and communicating with the accommodating cavity, wherein the slot has a depth equal to the accommodating cavity; the driving head also including an orifice obliquely extending downward from a central portion of a bottom end thereof and a horizontal notch defined on a rear end thereof, wherein a depth of the horizontal notch is equal to the slot;

a rotatory block fixed in the driving head and including a first toothed section accommodated in the accommodating cavity and a second toothed section received in the toothed groove;

an abutting member fixed in the slot and including an elastic steel ball retained in a rear end thereof, a plurality of locking teeth arranged around a front end thereof, an aperture formed on a bottom end thereof and corresponding to the orifice of the slot, and a resilient element mounted in the orifice and the aperture;

a pushing post fixed in the horizontal notch of the driving head and including a peripheral recess defined around an outer rim of a central section thereof to correspond to the steel ball of the abutting member, wherein one end of the pushing post is screwed with a screwing element;

a cover locked on the driving head by ways of plural locking elements to cover the abutting member and the pushing post.

2. The positioning device for the ratchet wrench as claimed in claim 1, wherein when the pushing post is located relative to a central position of a rear end of the abutting member, the steel ball is engaged in the peripheral recess of the pushing post.

3. The positioning device for the ratchet wrench as claimed in claim 1, wherein when the pushing post is pushed leftward or rightward, the steel ball of the abutting member disengages from the peripheral recess of the pushing post to abut against the pushing post.

* * * * *